US010344476B2

(12) United States Patent
Sorensen et al.

(10) Patent No.: US 10,344,476 B2
(45) Date of Patent: Jul. 9, 2019

(54) LIGHTING FIXTURES AND METHODS FOR GRID CEILING SYSTEMS

(71) Applicant: ABL IP Holding LLC, Decatur, GA (US)

(72) Inventors: Christopher J. Sorensen, Denver, CO (US); Joshua J. Miller, Highlands Ranch, CO (US); Carl T. Gould, Golden, CO (US); Peter K. Nelson, Denver, CO (US); Kevin F. Leadford, Evergreen, CO (US); Christopher D. Slaughter, Denver, CO (US)

(73) Assignee: ABL IP Holding LLC, Atlanta, GA (US)

( * ) Notice: Subject to any disclaimer, the term of this patent is extended or adjusted under 35 U.S.C. 154(b) by 126 days.

(21) Appl. No.: 15/271,676

(22) Filed: Sep. 21, 2016

(65) Prior Publication Data

US 2017/0082253 A1 Mar. 23, 2017

Related U.S. Application Data

(60) Provisional application No. 62/221,362, filed on Sep. 21, 2015.

(51) Int. Cl.
*E04B 9/00* (2006.01)
*F21S 8/00* (2006.01)
(Continued)

(52) U.S. Cl.
CPC ..... *E04B 9/006* (2013.01); *F21S 8/038* (2013.01); *F21S 8/06* (2013.01); *F21V 21/048* (2013.01); *F21V 21/30* (2013.01); *F21V 21/34* (2013.01); *E04B 9/067* (2013.01); *E04B 9/127* (2013.01); *F21Y 2115/10* (2016.08)

(58) Field of Classification Search
CPC ..... F21S 2/005; F21S 4/00; F21S 4/15; F21S 8/06; F21S 8/038; F21V 21/02; F21V 21/03; F21V 21/047–21/049; E04B 9/006
See application file for complete search history.

(56) References Cited

U.S. PATENT DOCUMENTS 6,421,904 B1 * 7/2002 Wedekind ..... E04B 9/006 29/432
8,177,385 B2 * 5/2012 Porciatti ..... E04B 9/006 362/147

(Continued)

*Primary Examiner* — Gerald J Sufleta, II
(74) *Attorney, Agent, or Firm* — Kilpatrick Townsend & Stockton LLP

(57) ABSTRACT

A luminaire configured for mounting to a grid ceiling system includes first and second portions. The first portion includes a first housing, one or more first mating elements, and a light engine coupled with the first housing that generates light from electrical power, and is oriented to emit the light away from the first housing. The second portion includes a second housing and one or more second mating elements. The second mating elements are adapted to couple with the first mating elements. At least one of the first portion and the second portion includes an electrical receptacle for receiving the electrical power for the light engine. When the first mating elements couple with the second mating elements, the first housing and the second housing together define a cavity for one or more members of the grid ceiling system.

20 Claims, 14 Drawing Sheets

(51) Int. Cl.

| | |
|---|---|
| ***F21S 8/06*** | (2006.01) |
| ***F21V 21/04*** | (2006.01) |
| ***F21V 21/30*** | (2006.01) |
| ***F21V 21/34*** | (2006.01) |
| *F21Y 115/10* | (2016.01) |
| *E04B 9/06* | (2006.01) |
| *E04B 9/12* | (2006.01) |

(56) References Cited

U.S. PATENT DOCUMENTS

2004/0213003 A1* 10/2004 Lauderdale ..... E04B 9/006 362/404
2006/0262521 A1* 11/2006 Piepgras ..... E04B 9/006 362/149
2009/0279298 A1 11/2009 Mier-Langner et al.
2010/0027247 A1* 2/2010 Olsen ..... F21S 9/035 362/183
2010/0197148 A1* 8/2010 Rudisill ..... H01R 11/30 439/40
2011/0026238 A1* 2/2011 Kim ..... F21S 2/005 362/84
2012/0230019 A1* 9/2012 Peifer ..... F21S 8/026 362/147
2013/0083514 A1* 4/2013 Wong ..... F21S 8/046 362/147
2014/0226316 A1* 8/2014 Medendorp, Jr. ..... F21S 8/043 362/147
2014/0237836 A1* 8/2014 Yaphe ..... G01B 3/14 33/528
2014/0329395 A1* 11/2014 Myers ..... H01R 25/142 439/110
2015/0267905 A1* 9/2015 Lee ..... F21V 21/048 362/150
2015/0301781 A1 10/2015 Ekkaia et al.
2015/0312975 A1* 10/2015 Tischler ..... H01S 5/042 315/294
2016/0017604 A1* 1/2016 White ..... E04B 9/006 52/28
2016/0061395 A1* 3/2016 White ..... F21S 2/00 362/147
2016/0116118 A1* 4/2016 Bernard ..... F21S 8/026 362/224

* cited by examiner

FIG. 8
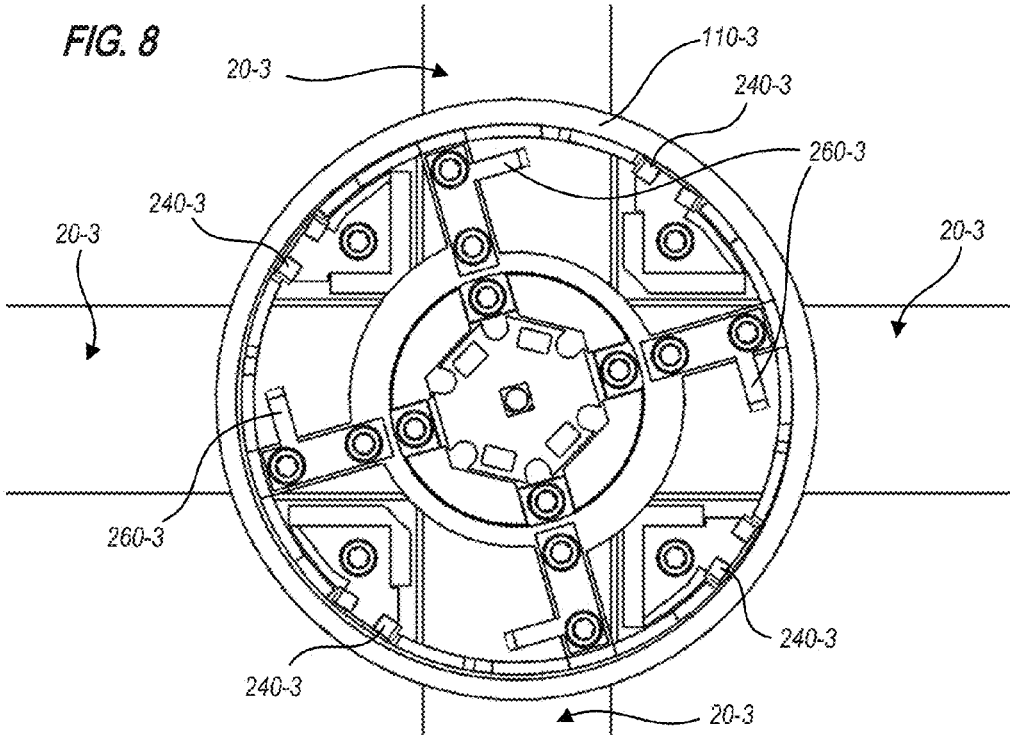
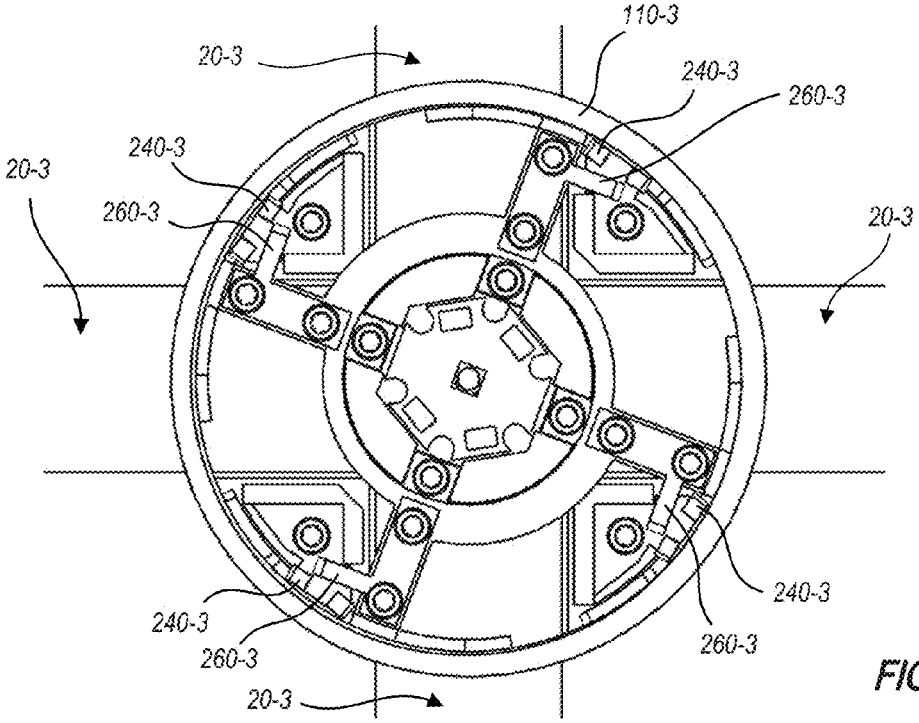
FIG. 9

LIGHTING FIXTURES AND METHODS FOR GRID CEILING SYSTEMS

CROSS-REFERENCE TO RELATED APPLICATIONS

This application claims priority to U.S. Provisional Patent Application No. 62/221,362, filed 21 Sep. 2015 and entitled "LIGHTING FIXTURES AND METHODS FOR GRID CEILING SYSTEMS," which is incorporated herein in its entirety for all purposes.

BACKGROUND

Some architectural spaces feature grid ceiling systems, in which grid elements are placed within a space with a high ceiling, to create a feel of an upper boundary to the space, even though the actual ceiling is higher. For example, there may be a network of any kind of grid elements (e.g., pipes, tubes, slats, nets, webbing and the like) that crisscross the space, such that occupants of the space perceive the grid elements as an upper boundary. The grid elements are usually supported from a ceiling, but sometimes supported by walls or a floor. Providing light to spaces that feature grid ceiling systems presents unique challenges.

SUMMARY

In an embodiment, a luminaire configured for mounting to a grid ceiling system includes a first portion and a second portion. The first portion includes a first housing, one or more first mating elements coupled with the first housing, and a light engine coupled with the first housing that generates light from electrical power, and is oriented to emit the light away from the first housing. The second portion includes a second housing, and one or more second mating elements coupled with the second housing, the one or more second mating elements being adapted to couple with the one or more first mating elements. At least one of the first portion and the second portion includes an electrical receptacle for receiving the electrical power from an external source for the light engine. When the one or more first mating elements couple with the one or more second mating elements, the first housing and the second housing together define a cavity for one or more members of the grid ceiling system.

In another embodiment, a luminaire configured for mounting to a grid ceiling system includes a first portion, a second portion and a pivot saddle. The first portion includes a first housing that defines a semicylindrical recess on an upper surface thereof, one or more first mating elements, and a light engine oriented to emit light away from the first housing. The second portion includes a second housing that defines a semicylindrical recess on a lower surface thereof, and one or more second mating elements that are adapted to couple with the one or more first mating elements. The pivot saddle includes a pivot saddle body shaped as a cylinder portion and defining a recess adapted to couple with the grid ceiling system member. At least one of the first portion and second portions includes an electrical receptacle for receiving electrical power for the light engine from an external source. The second housing, the one or more second mating elements and the one or more first mating elements are sized and arranged so that when the first and second mating elements couple with the pivot saddle disposed within the semicylindrical recesses of the first and second housings, the pivot saddle transfers a weight of the luminaire to the grid ceiling system member.

In a further embodiment, a luminaire is configured for mounting with a grid ceiling system. The grid ceiling system includes at least one grid member that extends along an axis that defines a polar angle thereabout. The luminaire includes a housing that forms an aperture therethrough, the aperture extending from a first lateral side to a second, opposing lateral side. The aperture defines a size and shape sufficient to allow the at least one grid member to pass through the housing, and the housing encompasses all polar angles defined by the axis when the at least one grid member is within the aperture. The housing encompasses all polar angles defined by the axis when the at least one grid member is within the aperture. The luminaire also includes an electrical receptacle for receiving electrical power from an external source, and a light engine that is operatively coupled with the electrical receptacle, and generates light using the electrical power.

BRIEF DESCRIPTION OF THE DRAWINGS

The present disclosure is described in conjunction with the appended figures:

FIGS. 8 and 9 provide enlarged bottom views of the lower portion of the multipart luminaire of FIG. 4 during the coupling operation described in connection with FIGS. 6 and 7.

DETAILED DESCRIPTION

Figure 1:
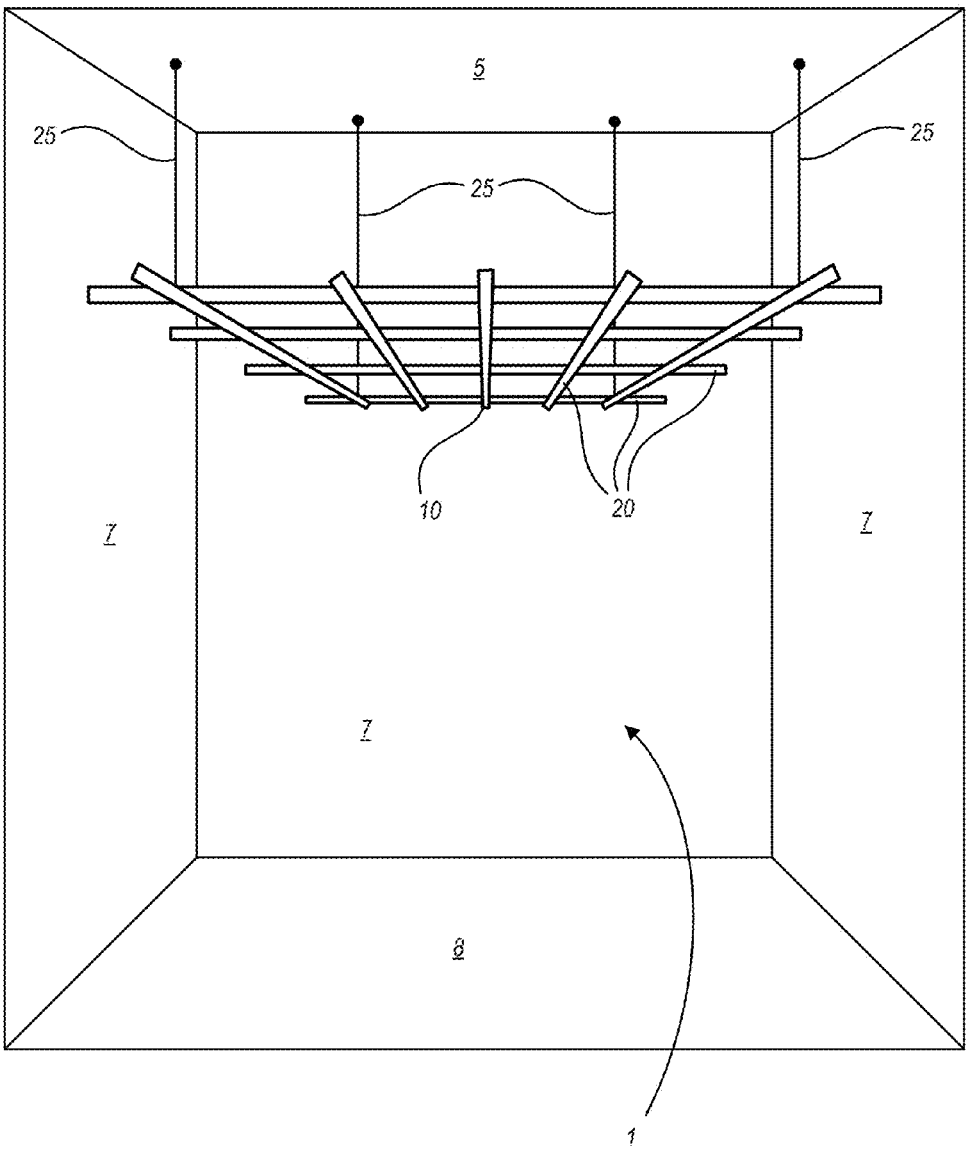
FIG. 1 illustrates a space that includes a grid ceiling system.

The present disclosure may be understood by reference to the following detailed description taken in conjunction with the drawings described below, wherein like reference numerals are used throughout the several drawings to refer to similar components. It is noted that, for purposes of illustrative clarity, certain elements in the drawings may not be drawn to scale. Specific instances of an item may be referred to by use of a numeral followed by a dash and a second numeral (e.g., luminaires 100-1, 100-2 etc.) while numerals not followed by a dash refer to any such item (e.g., luminaires 100). Numerals following dashes are not necessarily in consecutive order so as to preserve numbering consistency across drawings. Also, in instances where multiple instances of an item are shown, only some of the instances may be labeled, for clarity of illustration.

Embodiments herein provide new and useful lighting fixtures and methods for grid ceiling systems, particularly those that lack large surfaces (e.g., acoustical tile). Several embodiments will be discussed, and further embodiments equivalent to or intermediate to those discussed herein are within the scope of the present application.

FIG. 1 illustrates a space 1 that includes a grid ceiling system 10. Grid ceiling system 10 is not located at an actual ceiling 5 of space 1, but in FIG. 1 grid ceiling system 10 is suspended from ceiling 5 by support features 25, sometimes referred to as "tie offs" herein. Grid ceiling system 10 is typically dense enough, that is, has enough grid members 20 as compared with a floor or ceiling area of space 1, that grid ceiling system 10 can be perceived by occupants as an upper boundary of space 1, even though most of space 1 is open up to ceiling 5. In FIG. 1, grid ceiling system 10 is shown supported from ceiling 5 by support features 25, but grid ceiling systems may also be supported from walls 7 or floor 8.

Figure 2:
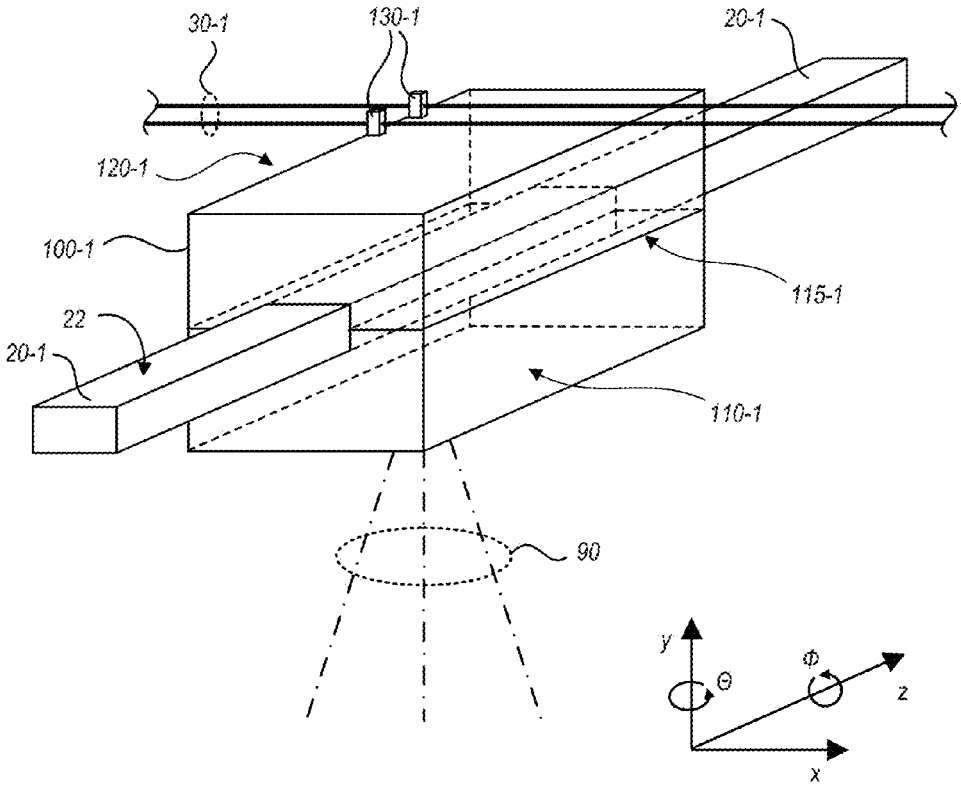
FIG. 2 is a generalized schematic diagram illustrating a multipart luminaire that assembles around a grid member, in accord with an embodiment.

FIG. 2 is a generalized schematic diagram illustrating a multipart luminaire 100-1 that assembles around a grid member 20-1. A coordinate system used to describe features of grid member 20-1 and luminaire 100-1 is provided. A direction noted as z is defined as being along a lengthwise direction of grid member 20-1. Z is a horizontal direction in FIG. 2, but need not always be (that is, grid members can be oriented lengthwise in directions that are not necessarily horizontal). A direction noted as y is defined as being upwards or toward zenith in a positive y direction, toward nadir in a negative y direction. In FIG. 2, since the z direction is horizontal, the y direction is perpendicular to the z direction, but this need not always be the case. A direction noted as x is defined as being horizontal and perpendicular to both the y and z directions. A rotation about the z axis is denoted as a $\phi$ direction and referred to herein as a polar angle, while a rotation about the y axis is denoted as a $\theta$ direction and referred to herein as an azimuthal angle.

Grid member 20-1 may have at least one upwardly facing surface 22. Certain grid ceiling installations may provide more upwardly facing surfaces 22, while other installations may simply feature an upwardly facing surface 22 as an upper side of a round object (e.g., when a grid member 20 is simply a cylindrical pole). Installed within a grid ceiling system, grid member 20-1 typically connects with other grid members 20, which collectively may obtain support from a ceiling, walls or floor (e.g., through support features 25, FIG. 1). Luminaire 100-1 includes a first portion 110-1 and a second portion 120-1, although in embodiments, luminaires herein may have only one portion, more than two portions, or portions that are nonrigidly connected with one another. In the embodiment shown in FIG. 2, second portion 120-1 sits atop, and thus obtains support from, upwardly facing surface 22. Other embodiments may form friction fits with grid members 20, to take the weight of the luminaire without such support coming explicitly from an upwardly facing surface. Some of these embodiments include one or more compressible materials that compress as the mating elements couple, to provide the friction fit. Still other embodiments include attachment points for tie offs to take all or part of the weight of a luminaire, and/or to support grid members 20. A shape of second portion 120-1 may be customized according to any shape of a grid member 20-1 that luminaire 100-1 is intended for use with, that is, second portion 120-1 can provide clearance and/or be adapted to fit about (or fit as closely as desired with) any single grid member 20-1, or any combination of grid members 20-1. First portion 110-1 couples with second portion 120-1 (through mating elements, discussed below) along a seam 115-1, so that a weight of first portion 110-1 is transferred to second portion 120-1 and thus grid member 20-1. Seam 115-1 is illustrated as a plane in FIG. 2, and may be a plane when outer housings of first portion 110-1 and second portion 120-1 couple rotationally. However, mating elements within first portion 110-1 and second portion 120-1 need not be planar, and outer housings of first portion 110-1 and second portion 120-1 are not planar in embodiments.

Typically, first portion 110-1 includes a light engine (e.g., light engine 250, FIGS. 10A, 13) that is oriented to emit light 90 away from the luminaire, usually downwards in the negative y direction shown in FIG. 2. In certain embodiments, light 90 is directed toward nadir, but in other embodiments, light 90 is directed in a particular direction, such as toward an object or a wall. Also, in embodiments, some portion of light 90 may be directed upwards to illuminate a space above the grid ceiling system. Second portion 120-1 typically includes electrical receptacles 130-1 that connect with an external power source 30-1, to receive and transmit electrical power to first portion 110-1 for use in generating light 90. However, in embodiments, second portion 120-1 may include a light engine that transmits light to first portion 110-1, which then redirects light 90. In certain embodiments, receptacles 130 are integrated with first portion 110 instead of second portion 120.

Multipart luminaires for grid ceiling systems can have or provide many features as described in exemplary embodiments below. Generally, a first portion (e.g., first portion 110-1) has a first housing that fits around, or at least provides clearance for, a downwardly facing feature of the grid ceiling system. In certain embodiments, the first portion may simply form a flat surface that will be positioned adjacent to or below the downwardly facing feature, but the first portion may provide clearance for, and/or be adapted to fit about (or fit as closely as desired with) any grid member 20, or combinations of two or more grid members 20. A second portion (e.g., second portion 120-1) has a second housing that is adapted to obtain support from at least one upwardly facing feature of the grid ceiling system. Similarly, the first portion may provide clearance for, and/or be adapted to fit about (or fit as closely as desired with) any grid member 20, or combinations of two or more grid members 20. Mating elements within the first portion and the second portion couple so that weight of the first portion transfers to the second portion and thus to the grid ceiling system. The second portion has one or more electrical receptacles 130 that receive electrical power from an external source, and internal connections (often, but not necessarily, provided at the mating elements) that transfer the power to the first portion so that a light engine therein can generate light. In the present disclosure, when referring to multipart luminaires herein that have two or more portions that join to form a complete luminaire, a lower one of the portions may be referred to as a first portion and an upper one of the portions as a second portion. However, positioning of the first and second portions as upper and lower is not a requirement, nor is locating specific components such as electrical receptacles, light engines and the like, within a specific one or the other of the portions.

Specific embodiments can have many variations on the general features noted above. For example, the mating elements can be magnets; in some embodiments both the first portion and the second portion have magnets of opposing polarities that attract one another, while in other embodiments only one or more of the mating elements are magnets and corresponding element(s) on the opposing luminaire are ferromagnetic materials (e.g., steel) such that the magnet(s) attract the corresponding element(s). In still other embodiments, mating elements are mechanical and are simply pressed together, such as snap type or plug-and-socket type elements. In yet other embodiments, mating elements have one or more latching features, such as latches, hasps or bayonet type connectors. There may be any number of corresponding sets of mating elements between the first and the second portions. When the first portion and the second portion are symmetrical to any degree, the mating elements may be keyed such that the first portion and the second portion can only go together in a unique orientation out of several otherwise possible orientations. The keying can be mechanical and/or magnetic; e.g., north and south poles of magnets may be disposed adjacent to one another so as to attract one another only in correct orientations, while similar poles repel one another in incorrect orientations. In embodiments, keying acts to ensure correct polarity of electrical connections that are made when the second portion and the first portion are coupled.

In embodiments, weight of luminaires 100 is transferred to any combination of grid members 20, support features 25 (see FIG. 1) (sometimes referred to as "tie offs") and/or intermediate structures such as brackets that couple with support features 25. Luminaires 100 may include mechanical features that directly couple with, and transfer weight to, support features 25 and/or brackets supported therefrom, in addition to or instead of transferring weight to grid members 20. Such mechanical features may include friction fits and/or mechanical features such as clamps or set screws.

The electrical connections that transfer power from an external power source to a second portion 120 (e.g., electrical receptacles 130) may be implemented in many forms that depend on how the external power is provided. In the following discussion, the terms "power" and "ground" or "neutral" are used for ease of understanding by those skilled in the art, but it is to be understood that these terms simply describe conductors that are at different voltages, or that provide sources and sinks for electrical current, and thus encompass either AC or DC voltage and/or current based power schemes of any polarity.

In some embodiments, external power is provided by pairs of wires, or cables having both power and ground conductors therein. In such embodiments electrical receptacles 130-1 may be arranged as shown in FIG. 2 for a two wire version. Alternatively, a single receptacle that can couple with multiple conductors of a multi-conductor cable can be provided, or a single conductor receptacle can provide one of power and ground while the grid itself provides the other of power and ground. In certain grid ceiling systems, one or more conductors can be disposed upon one or more upwardly facing surfaces of a T-grid member, tucked alongside a vertical support portion thereof, with receptacles 130 arranged for convenient access to conductors in such locations. Receptacles 130 can be provided on a top surface of second portion 120, as shown in FIG. 2, or on a side surface thereof In other embodiments, power and ground (or neutral) are distributed across the grid ceiling system in other ways, such as power wires running in one direction and ground wires running in a different direction. In certain embodiments, receptacles 130 include prongs that pierce insulation of wires or cables and contact conductors within to make electrical contact. In still other embodiments, power may be supplied from wires or cables while grid members 20 act as ground conductors, in which case only a single external electrical receptacle 130 is required, and the ground connection is an internal connection to a grid member 20. In yet other embodiments, grid members integrate conductors for power distribution. Such conductors can be contacted either with external or internal connectors, depending on the type of access points made available by the grid members. In these and other embodiments, one set of receptacles 130 can receive external power at one location on a luminaire, and a second set of receptacles 130 at another location on the luminaire can connect with the first set of receptacles 130 and make external power available to other wiring or connectors to continue external power distribution throughout a grid ceiling system.

The electrical connections that transfer power from the second portion to the first portion may also be implemented in many forms. In some cases the mating elements are also the electrical connections (e.g., the magnets or mechanical fasteners are also electrical conductors themselves). In other cases the electrical connections are arranged so as to make contact only when the mating elements are mated. In yet other cases, separate connectors are provided that connect first and/or independently (e.g., before the first and second portions connect), and are disposed such that when the mating elements are mated later, the connectors are enclosed within the luminaire.

Certain embodiments herein utilize grid members 20 as heat sinks. For example, some of these embodiments position light emitters such as light-emitting diodes ("LEDs") near a top surface of a first portion 110, and optionally provide a low thermal resistance path from the light emitters to a thermal spreader at a top surface of first portion 110. When the mating elements mate to couple first portion 110 with second portion 120, the thermal spreader is brought into contact with the grid member 20 such that heat generated by the LEDs transfers to the grid member 20. (See, e.g., FIGS. 13, 14A, 14B, 16)

Certain embodiments herein are adapted for deployment along a single grid member 20. Some of these embodiments simply connect about the grid member 20, and are symmetric in terms of weight distribution. That is, by simply mating the respective mating elements of the second and first portions about the grid member 20, the luminaire 100 thus formed is in a natural state of repose, that is, the luminaire does not exert a torque on grid member 20 in the ϕ direction. A first portion 110 connecting loosely with a second portion 120 about a grid member 20 such that a mechanical clearance exists about the grid member 20 may be considered to have a non-binding fit. In other embodiments, a luminaire forms an aperture that conforms with a shape of a grid member 20, such that the luminaire resists rotation due to mechanical interference between the grid member 20 and one or more sides of the aperture. Still other embodiments grip the grid member 20, that is, apply mechanical and/or adhesive force to the grid member to counter a torque exerted by gravity on the luminaire in the ϕ direction. Such forces can be applied by providing second and first portions with close tolerances such that they mechanically couple with or press-fit firmly about the grid member 20; such embodiments may be considered to have a binding fit with the grid member 20. For example, surfaces of the first and/or second portions may include compressible material and clamp such material against the grid member. Or, further mechanical features such as clamps, set screws and/or adhesives may be provided.

In still other embodiments, a pivot saddle can be provided. (See, e.g., FIGS. 18, 19) The pivot saddle grips the grid member 20 and provides an outer surface that is at least a truncated cylinder portion. Each of the first and second portions defines a cylindrical recess section, such that when the mating elements couple the first and second portions, the cylindrical recess sections adjoin about the pivot saddle. In certain ones of these embodiments, the pivot saddle defines a central aperture or slot sized to fit the grid member snugly; the pivot saddle may deform elastically about the grid member so as to provide a friction fit. The first and second portions fit snugly enough that the luminaire retains its rotational position when released, but loosely enough that rotational position of the luminaire about the grid member can be adjusted by hand (e.g., in the ϕ rotational direction). Optionally, detents can be provided, in the pivot saddle and/or in the first and second portions, to limit the rotational positions into which the luminaire can be twisted, but to increase the torque required to move the luminaire from one rotational position to another. Again, in these embodiments, further mechanical elements such as set screws, clamps, tighteners, latches and/or adhesives, may be provided to fix the luminaire in a specific rotational position.

Still more embodiments are adapted for deployment at intersections of grid members within a grid ceiling system. (See, e.g., FIGS. 4-12, 14A, 14B) These embodiments typically fix rotational angle of the luminaire in the ϕ direction, because the first and second portions close about grid members that extend in orthogonal directions. In some cases, grid members 20 may intersect and can be thought of as partitioning a surrounding space into segments bounded by the grid members. In these cases, sets of mating elements may be provided, each set being disposed within one segment of the arrangement formed by the grid members. In cases where one grid member intersects another to form a T shape, either three of four sets of mating elements may be provided, surrounding the intersection thus formed. In some such cases, the grid members 20 lie within a common plane (usually a substantially horizontal plane). In other cases, one or more of the intersecting grid members 20 is tilted or fully vertical; embodiments herein can be configured to encompass the intersection thus formed and provide a luminaire at or near the intersection.

Certain embodiments provide a pivot saddle that forms a cylindrical section around one or more grid members to allow at least limited rotation of a luminaire about the pivot saddle, and in some cases, full circle rotation about the pivot saddle. These embodiments are useful at locations of grid ceiling systems adjacent to walls, to adjust a height of a spot of light on a wall; to focus on an object on display; and at locations such as corners, where adjustability of a light pattern to fill an adjoining space beyond the extent of the grid ceiling system is desired.

Second portion 120 and/or first portion 110 may have portions that are movable. In particular, first portion 110 may have a portion that can swivel azimuthally (e.g., in the θ rotational direction) to allow light to be directed accordingly. Also, second portion 120 and/or electrical receptacles 130 may have movable features to increase convenience and/or accessibility during installation, while electrical receptacles 130 are connected with external power sources 30.

First portions 110 and second portions 120 may be provided as separate units and assembled about grid members, or they may be connected with one another to some degree even before assembly. For example, in embodiments, a first portion 110 and a second portion 120 may be co-molded with, or attached to, a flexible coupling (e.g., a living hinge). This may expedite stocking, shipping, handling and assembly by ensuring that a specific first portion and corresponding second portion travel with, and are always on hand for, one another. In similar embodiments, a first portion 110 and a second portion 120 may be loosely connected with one another before assembly with one or more articulated or flexible, mechanical and/or elastic coupling elements (e.g., hinges, chains, elastic connectors and the like). In some of these embodiments, the one or more elastic and/or mechanical coupling elements form a first mating element on one side of a grid element, while a second mating element (e.g., a clasp, hasp, latch or the like) is provided to complete a connection on another side of the grid element.

Still other embodiments generate light within second portion 120 and emit at least a portion of the light thus generated through first portion 110. In first portion 110, optics may then direct the light as desired as it exits the luminaire. Light transmission in such embodiments can be accomplished by using fiber optics, light pipes or free space optics. In these and other embodiments, the "first" portion 110 may be either a lower or upper portion, while the "second" portion 120 is a corresponding other one of the lower and upper portion.

Figure 3A:
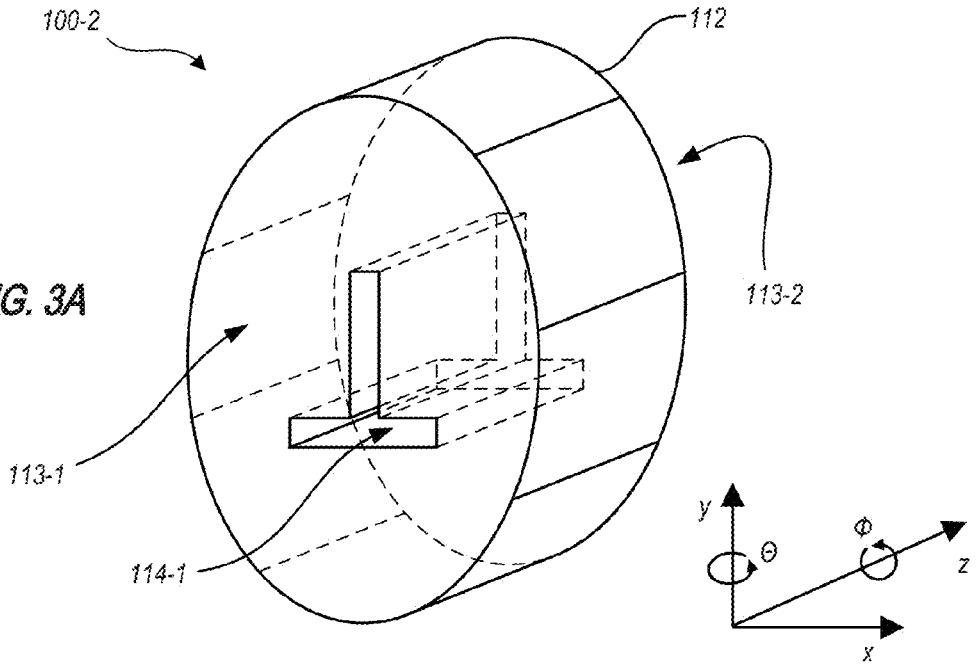
FIGS. 3A and 3B illustrate a luminaire that has a single housing that defines an aperture therethrough, in accord with an embodiment.
Figure 3B:
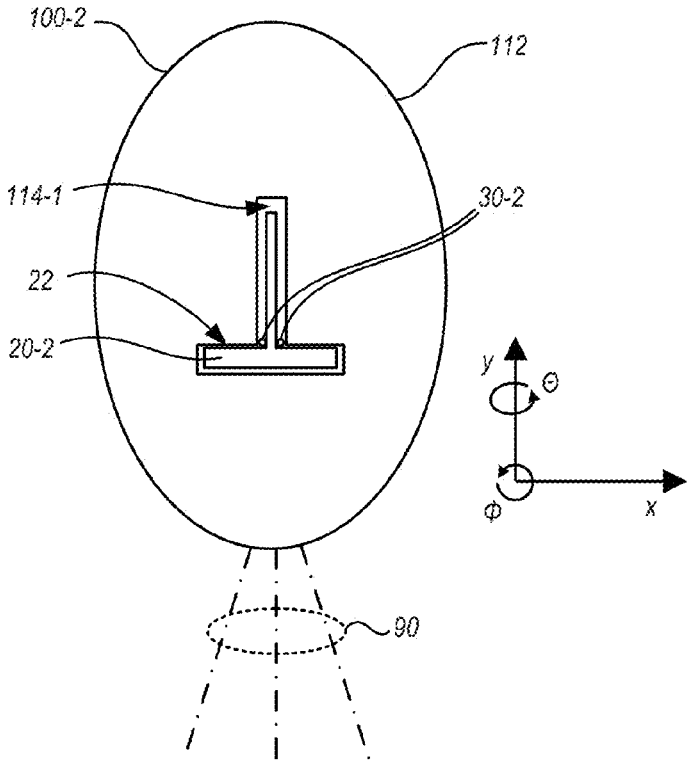

In still more embodiments, a luminaire can provide a single housing that defines an aperture corresponding to a grid member 20. FIGS. 3A and 3B illustrate a luminaire 100-2 that has a single housing 112 that defines an aperture 114-1 therethrough. Aperture 114-1 thus extends from a first lateral side 113-1 to a second, opposing lateral side 113-2 of housing 112. FIG. 3A is a perspective view showing housing 112 and aperture 114-1 alone, while FIG. 3B is an end elevation that shows luminaire 100-2 installed about a grid member 20-2 (in this case, a T-grid member). Aperture 114-1 is sized and shaped to fit about (or fit as closely as desired with, given reasonable mechanical tolerances) an intended grid member 20-2 to be installed therein; similar to embodiments described above, aperture 114-1 may be customized according to any shape of a grid member 20-2 that luminaire 100-2 is intended for use with. This allows housing 112 to obtain support from one or more upwardly facing surfaces 22 of grid member 20-2 while providing clearance for grid member 20-2. Grid member 20-2 can be, for example inserted through aperture 114-1 at a time of installation, and can couple with other grid members 20 to form the grid ceiling system, supporting luminaire 100-2. In this embodiment, luminaire 100-2 encompasses the grid member 20 in a mechanical sense, that is, luminaire 100-2 extends throughout all angles of ϕ as shown. The shape of aperture 114-1 prevents housing 112 from rotating about grid member 20-2, so that luminaire 100-2 remains in a particular angle ϕ, so that a direction of light 90 from luminaire 100-2 that is set at the time of installation remains stable. Housing 112 can include any of the features described above in connection with either first portion 110, second portion, 120, or both. In particular, connectors (hidden in the view of FIG. 3B) connect with external power source 30-2, which in this case takes the form of conductors disposed against internal corners of T-grid member 20-2. Luminaire 100-2 emits light 90 into an illuminated space below. As discussed above, optics or positioning of light sources within luminaire 100-2 can direct light 90 either toward nadir or in other ϕ or θ directions, and across any range of angles.

Systems formed of luminaires herein can advantageously deploy not only luminaires such as luminaire 100-1 and 100-2, FIGS. 2, 3A and 3B, but also dummy units that do not emit light, but provide visual continuity, and sometimes provide cost and/or other advantages. For example, dummy units may cost much less to manufacture than luminaires (by omitting light emitters, optics, driver electronics and the like) yet may have an identical appearance to nearby luminaires when the luminaires are turned off. When light needed in an area is less than would be generated by a full set of luminaires, dummy units can substitute for some of the luminaires. Also, dummy luminaires can be used to house electronics that are not needed at every luminaire, for example AC-to-DC or DC-to-DC conversion electronics. The physical volume within each dummy unit that would ordinarily be occupied with light emitters and driver electronics can be used for this purpose. For example, a grid ceiling lighting system may only require one external power connection to a dummy unit that houses AC-to-DC conversion electronics, with output from such electronics then being connected with all of the actual luminaires of the system. Dummy units can also provide mechanically equivalent connectors for power distribution as are found in corresponding luminaires, such that wiring across a grid ceiling system that uses dummy units can be standardized (e.g., the dummy units maintain continuity of the power distribution scheme across the system).

Figure 4:
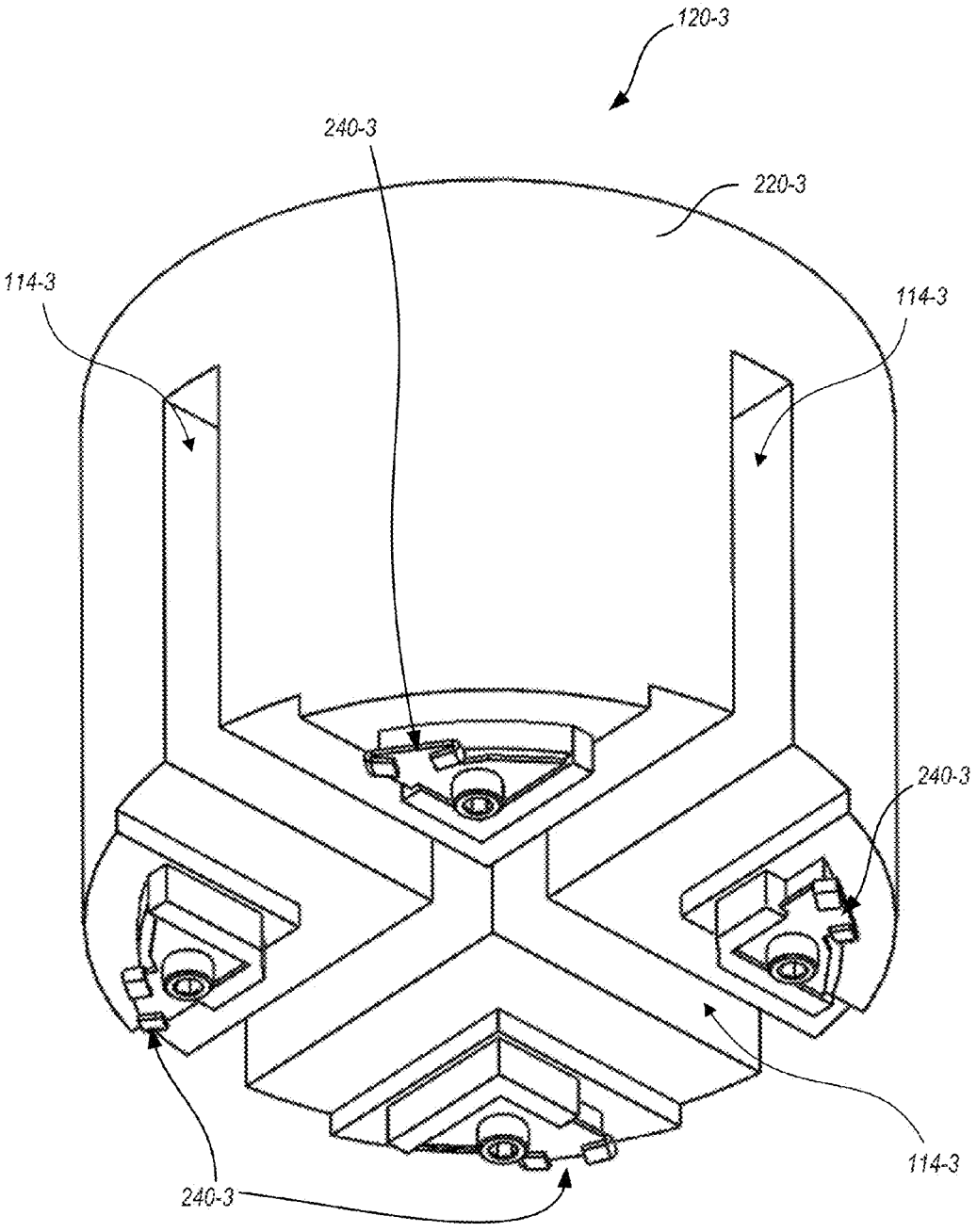
FIG. 4 illustrates an upper portion of a multipart luminaire that is configured for installation in a grid ceiling system, in accord with an embodiment.
Figure 5:
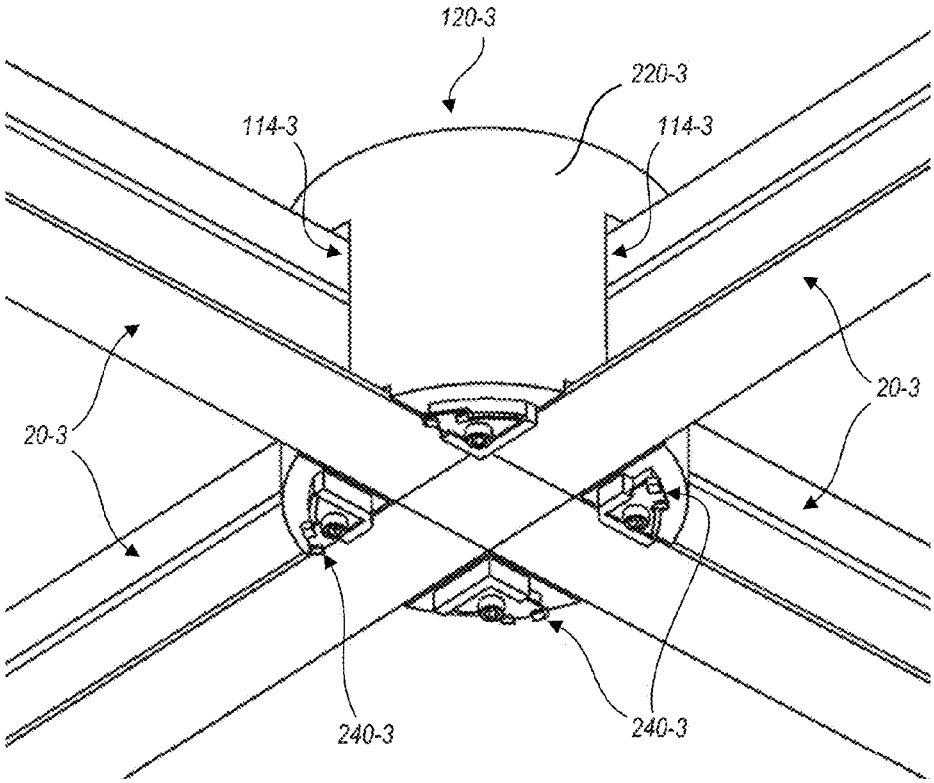
FIG. 5 illustrates an upper portion of the multipart luminaire of FIG. 4, seated atop intersecting grid members.

FIG. 4 illustrates an upper (e.g., second) portion 120-3 of a multipart luminaire that is configured for installation in a grid ceiling system. Upper portion 120-3 includes a housing 220-3 with which four mating elements 240-3 are coupled. Mating elements 240-3 may be formed of metal, for example, and can thus also act as electrical contacts, as discussed below. Housing 220-3 includes apertures 114-3, in this case slots, that serve a similar purpose as aperture 114-1 (FIGS. 3A, 3B) in forming a part of a mechanical fit of housing 220-3 to grid members, and in providing clearance for the grid members. FIG. 5 illustrates upper portion 120-3 seated atop intersecting grid members 20-3, with upper portions of grid members 20-3 passing through slots 114-3.

Figure 6:
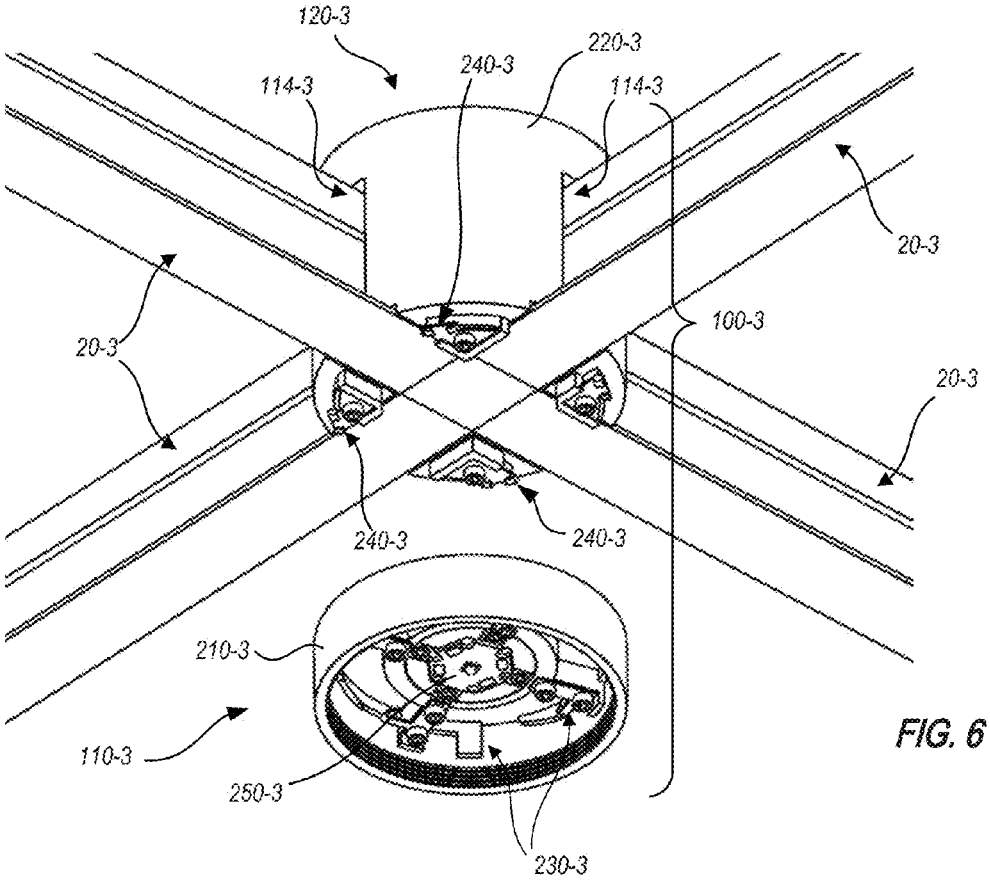
FIG. 6 illustrates the upper portion and grid members as in FIG. 5, with a lower portion of the multipart luminaire of FIG. 4 approaching the upper portion, as it would during installation.
Figure 7:
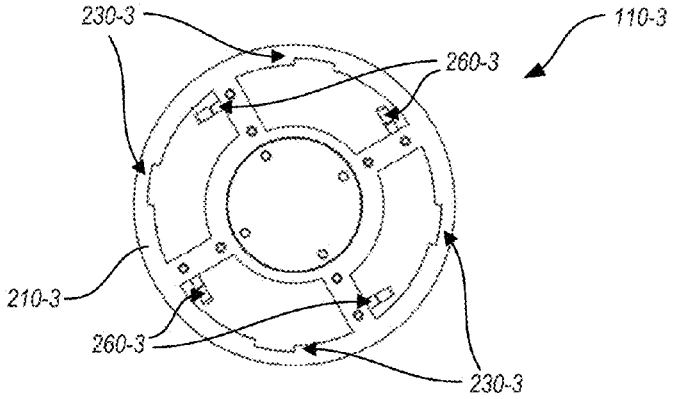
FIG. 7 illustrates the lower portion of the luminaire of FIG. 4, in a top view.

FIG. 6 illustrates upper portion 120-3 and grid members 20-3 as in FIG. 5, with a lower (e.g., first) portion 110-3 proximate upper portion 120-3 as it would during installation of luminaire 100-3. FIG. 7 illustrates lower portion 110-3 in a top view, and shows electrical contacts 260-3. A light engine 250-3 generates light that can be transmitted directly, and/or can be modified by optics such as lenses, diffusers or the like before leaving luminaire 100-3.

Lower portion 110-3 includes a housing 210-3 with which four mating elements 230-3 are coupled (some of mating elements 230-3 are hidden in the view of FIG. 6). Each mating element 230-3 is a protrusion from an inner wall of housing 210-3; a horizontal member thereof is configured to slide over a corresponding mating element 240-3 to obtain mechanical support therefrom, while a vertical member thereof forms a rotation stop. Mating elements 230-3 and 240-3, and thus upper portion 120-3 and lower portion 110-3, couple by first raising lower portion 110-3 from the position shown in FIG. 6, until mating elements 240-3 pass by mating elements 230-3 in a vertical direction. Then, lower portion 110-3 rotates relative to upper portion 120-3 until the horizontal members of mating elements 230-3 slide over mating elements 240-3. The rotation proceeds until further rotation is blocked (e.g., see FIGS. 8, 9). This mechanical arrangement is exemplary only; one of ordinary skill in the art would recognize many variations, modifications, and alternatives. This coupling causes mechanical between mating elements 230-3 and 240-3, and electrical coupling between mating elements 240-3 and electrical connectors 260-3 (see FIGS. 7-9) so that lower portion 110-3 is supported and electrical power can pass from upper portion 120-3 to lower portion 110-3.

Slots 114-3 in housing 220-3 form clearances for all parts of grid members 20-3 so that housing 210-3 can have a simple cylindrical shape and fit flush against housing 220-3. That is, when mating elements 230-3, 240-3 are coupled, housings 210-3 and 220-3 collectively define a cavity therebetween for grid members 20-3. However, it will be clear to one skilled in the art upon reading and comprehending the present disclosure that this could be reversed for certain grid configurations, with an lower housing 210 forming slots and a upper housing 220 forming a shape with a flat edge. It is also contemplated that shapes of lower housing 210 and upper housing 220 may collectively define a cavity for grid members 20 when mating elements 230 fit together in other ways, such as with snap or friction fits (e.g., see FIGS. 10A, 10B, 18 and 19 below). Also, although upper portion 120-3 and lower portion 110-3 are shown configured to accommodate grid members 20-3 and 20-4 that cross at ninety degree angles, it should be clear that luminaires disclosed herein can be adapted for other configurations of grid members 20. For example, upper portion 120-3 and lower portion 110-3 could be installed without modification at a T type intersection of grid members 20. In other embodiments, upper portions 120 and/or lower portions 110 may be modified for installation at grid intersections that are not at ninety degree angles, or do not lie in a single plane (e.g., some grid members 20 may slope upwards or downwards from a grid intersection).

FIGS. 8 and 9 provide enlarged bottom views of upper portion 120-3 and lower portion 110-3 during the coupling operation described above in connection with FIGS. 6 and 7. In FIG. 8, mating elements 240-3 have been inserted into a location that is mechanically clear of mating elements 230-3, as shown. In FIG. 9, electrical contacts 260-3 are shown in contact with mating elements 240-3 to as to make electrical contact between lower portion 110-3 and upper portion 120-3.

When assembled, lower portion 110-3 and upper portion 120-3 encompass grid members 20-3. The term "encompass" is used herein in the sense that a luminaire that encompasses a grid member provides structure at all polar angles about grid members and is substantially coupled thereto. For example, although normal manufacturing and assembly tolerances may introduce gaps between luminaires herein and grid members, the luminaires herein do not simply hang from grid members; a luminaire that simply hooks over a grid member through a gap in one side of the luminaire would not be considered to encompass the grid member. "Substantially coupled" means herein that at least enough mechanical contact exists between assembled portions of a luminaire such that a luminaire holds its position relative to the grid member to which it is coupled, in the absence of outside forces. The mechanical contact may, however, form a friction fit that can be overcome by hand, with or without the use of special tools.

Figure 10A:
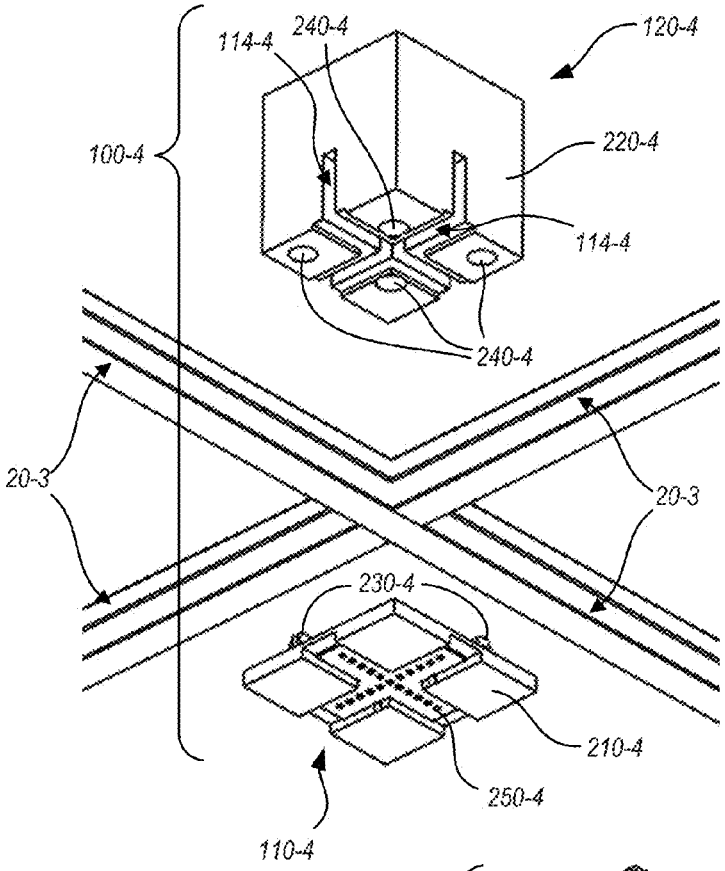
FIGS. 10A and 10B illustrate an upper portion and lower portion of a multipart luminaire that is configured for installation in a grid ceiling system, in accord with an embodiment.
Figure 10B:
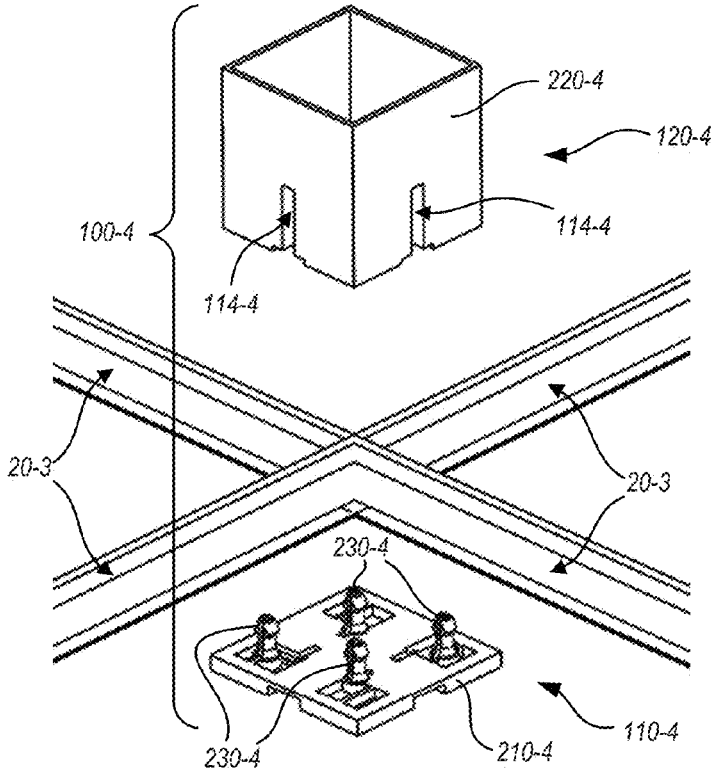

FIGS. 10A and 10B illustrate an upper portion 120-4 and lower portion 110-4 of a multipart luminaire 100-4 that is configured for installation in a grid ceiling system. Both FIGS. 10A and 10B are exploded diagrams, with FIG. 10A being seen from below grid members 20-3 (e.g., the same type of grid members as shown in FIGS. 5, 6, 8 and 9) and FIG. 10B being seen from above grid members 20-3. Upper portion 120-4 includes a housing 220-4 that includes four mating elements 240-4. Mating elements 240-4 also include electrical connectors, not visible in FIGS. 10A and 10B, but discussed below in connection with FIGS. 11 and 12. Lower portion 110-4 includes a housing 210-4 that includes four mating elements 230-4 that are configured to couple with mating elements 240-4. Housing 220-4 includes slots 114-4 that serve a similar purpose as slots 114-3 (FIGS. 4, 5, 6) such that when mating elements 230-4, 240-4 are coupled, housings 220-4 and 210-4 collectively define a cavity for grid members 20-3. When assembled, lower portion 110-4 and upper portion 120-4 encompass grid members 20-3, that is, they provide structure at all polar angles about grid members 20-3 and are fixedly coupled thereto.

Lower portion 110-4 also includes a light engine 250-4 that emits light (e.g., light 90, FIG. 2) away from lower housing 210-4. Light engine 250-4 may be oriented horizontally, as shown, and may include one or more Lambertian emitters that provide a photometric distribution that is centered at nadir. In other embodiments, a light engine 250 may be mounted at a tilt within a lower portion 110, and/or may include optics for redirecting the photometric distribution to directions other than nadir.

Figure 11:
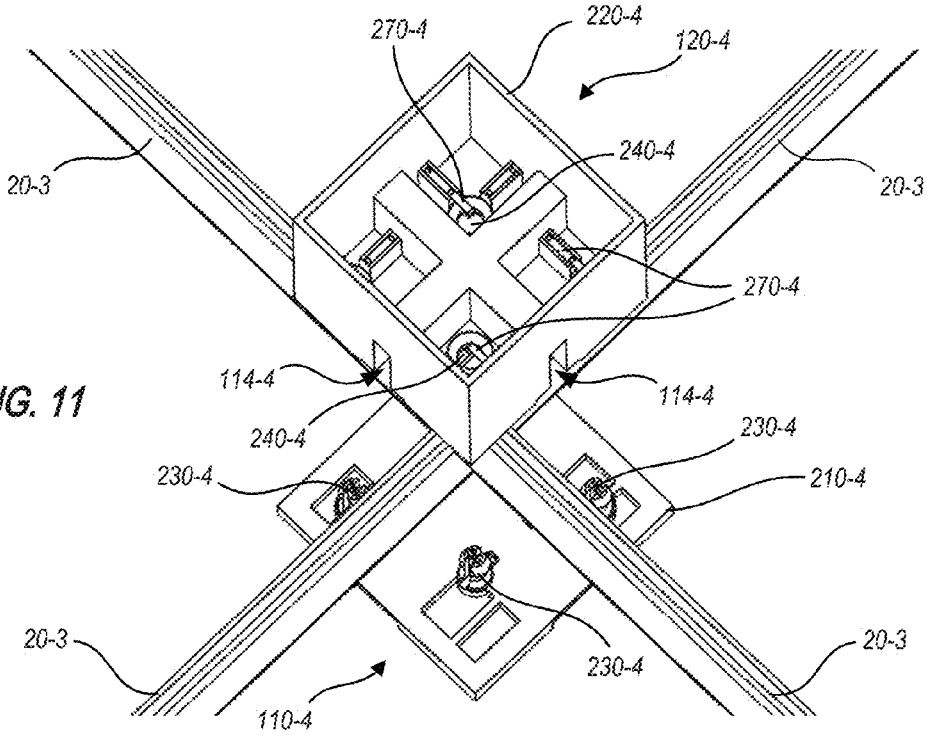
FIGS. 11 and 12 are enlarged views of upper portion and the lower portion 110 of the multipart luminaire of FIGS. 10 and 10B.
Figure 12:
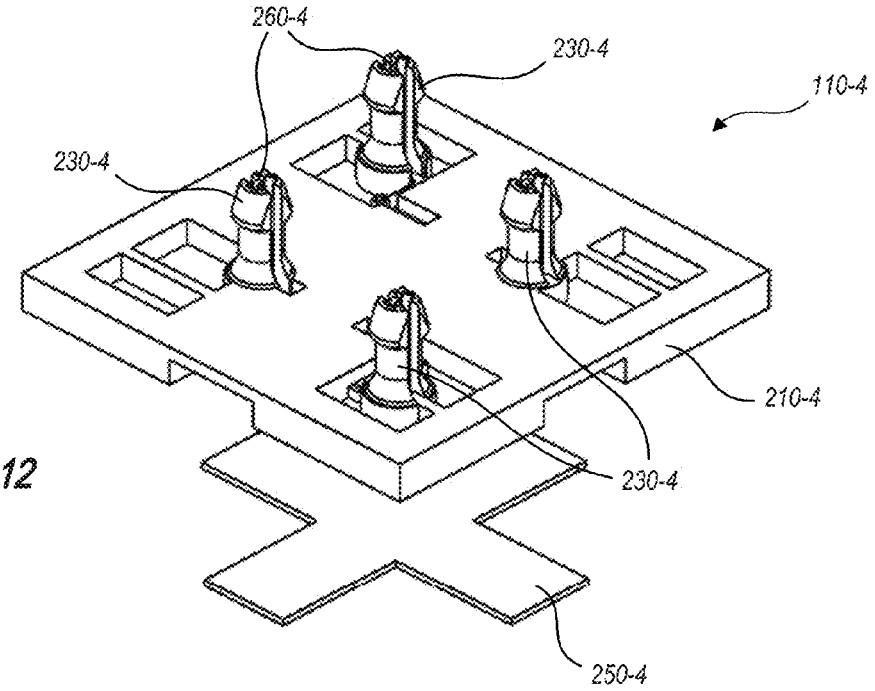

FIGS. 11 and 12 are further views of upper portion 120-4 and lower portion 110-4 that illustrate details of mating elements and electrical connectors thereof. As shown in FIG. 12, mating elements 230-4 are split pins that surround electrical connectors 260-4. Electrical connectors 260-4 are configured to extend just above upper ends of mating elements 230-4. As shown in FIG. 11, mating elements 240-4 are sockets sized to receive mating elements 230-4. Upper portion 120-4 includes spring type electrical connectors 270-4 such that when ends of mating elements 230-4 couple within mating elements 240-4, electrical connectors 260-4 will touch connectors 270-4 to complete circuits. Other configurations are possible and will be evident to those skilled in the art. The split-pin configuration of mating elements 230-4 allows for deformation of the pins as lower portion 110-4 and upper portion 120-4 are assembled, that is, the split pins will squeeze together as a head portion of each mating element 230-4 passes through a neck of each socket in a mating element 240-4. Once the head portion passes through the neck, the split pins snap outward toward their initial positions, securing lower portion 110-4 with upper portion 120-4. In other embodiments, straight pins may be used in a friction fit configuration; electrical connectors may form one or more of the pins or sockets themselves, and the like. Also, it can be seen that placement of mating elements 230-4 and 240-4 can be arranged so as to form a keyed arrangement in which lower portion 110-4 can be attached to upper portion 120-4 in only one rotational orientation, so that electrical connectors 260-4 and 270-4 complete circuits as intended. One of ordinary skill in the art would recognize many variations, modifications, and alternatives.

Figure 13:
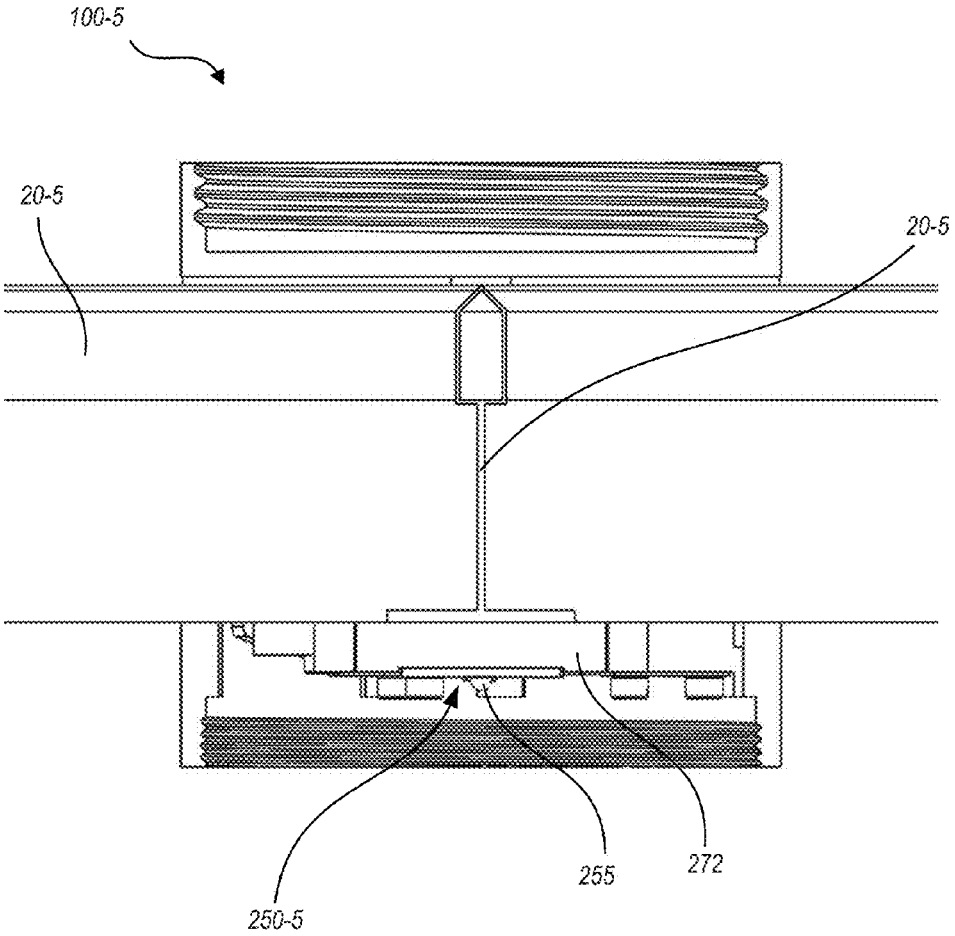
FIG. 13 is a cutaway illustration of a luminaire that uses grid elements as heat sinks, in accord with an embodiment.

FIG. 13 is a cutaway illustration of a luminaire 100-5 that uses grid elements 20 as heat sinks. Luminaire 100-5 includes a light engine 250-5 that is internally disposed adjacent to a thermal spreader 272 within luminaire 100-5. A first grid member 20-5 is shown extending from right to left in the view of FIG. 13, while a second grid member 20-5 is shown in cross section, that is, it would extend into and out of the plane of FIG. 13. As light-emitting diodes (LEDs) 255 of light engine 250-5 generate light, they also generate heat that should be removed for best LED efficiency and reliability. When luminaire 100-5 is installed about grid members 20-5, thermal spreader 272 is in turn disposed adjacent to one or more grid members 20-5, as shown (in this case, thermal spreader 272 is disposed adjacent to the crossing point of both grid members 20-5). Thermal spreader 272 may be made for example of metal, or other materials having high thermal conductivity. Heat from LEDs 255 couples into thermal spreader 272 and subsequently to grid member(s) 20-5. Grid members 20-5 are typically made of good thermal conductors such as metal, and extend beyond luminaire 100-5, sometimes in more than one direction and within a short distance from thermal spreader 272. Thus, the heat from LEDs 255 is efficiently conducted away from light engine 250-5 by thermal spreader 272 and grid members 20-5, where it can readily dissipate to ambient air.

Figure 14A:
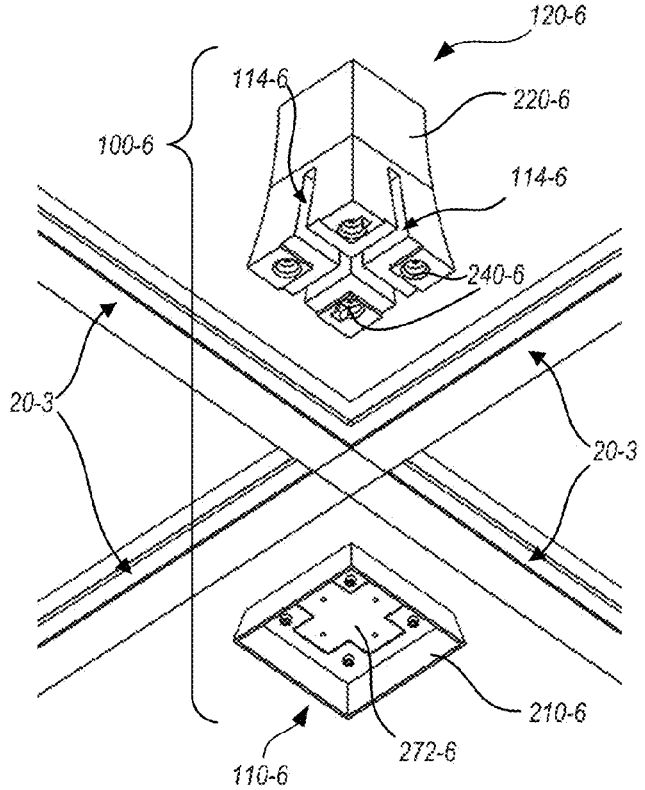
FIGS. 14A and 14B illustrate an upper portion and lower portion of a multipart luminaire that is configured for installation in a grid ceiling system, in accord with an embodiment.
Figure 14B:
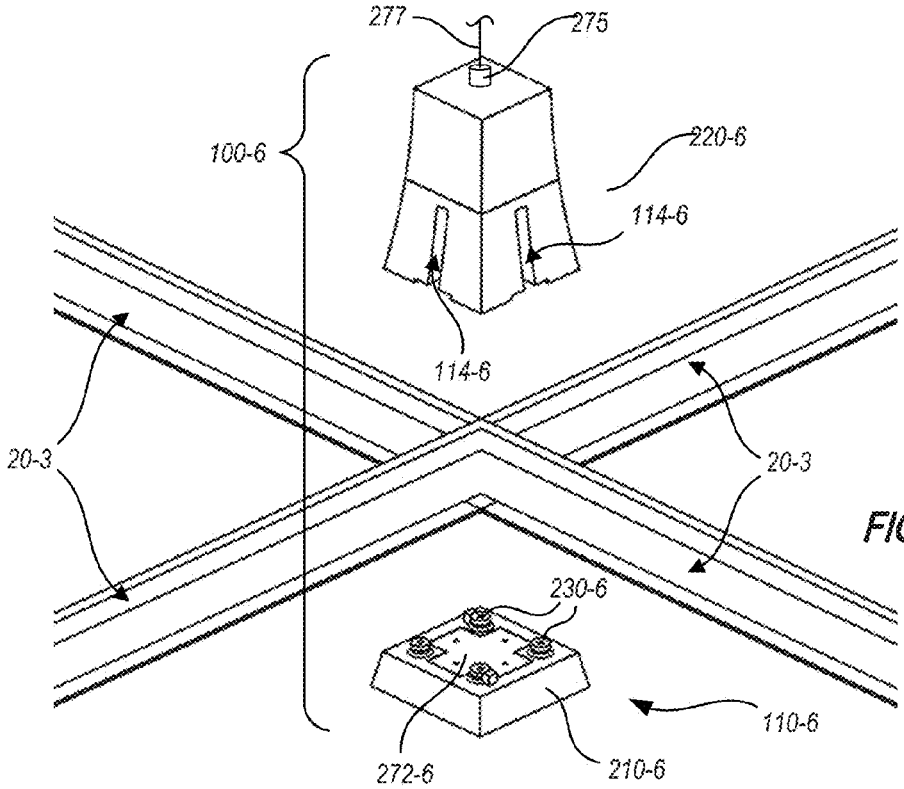

FIGS. 14A and 14B illustrate an upper portion 120-6 and lower portion 110-6 of a multipart luminaire 100-6 that is configured for installation in a grid ceiling system. Both FIGS. 14A and 14B are exploded diagrams, with luminaire 100-6 being viewed from below grid members 20-3 in FIG. 14A and being seen from above grid members 20-3 in FIG. 14B. Upper portion 120-6 includes a housing 220-6 that includes four mating elements 240-6. Mating elements 240-6 also include electrical connectors, not visible in FIGS. 14A and 14B, but discussed below in connection with FIGS. 15, 16 and 17. Lower portion 110-6 includes a housing 210-6 that includes four mating elements 230-6 that are configured to couple with mating elements 240-6. Lower portion 110-6 also includes a thermal spreader 272-6. A light engine 250 (e.g., any of light engines 250, FIGS. 10A, 13 and others) would be present in lower portion 110-6, but is omitted in FIG. 14A to avoid obscuring thermal spreader 272-6. Mating elements 230-6, 240-6 use magnets to secure lower portion 110-6 with upper portion 120-6, as discussed below. Housing 220-6 includes slots 114-6 that serve a similar purpose as other slots 114 such that when mating elements 230-6, 240-6 are coupled, housings 220-6 and 210-6 collectively define a cavity for grid members 20-3. When assembled, lower portion 110-6 and upper portion 120-6 encompass grid members 20-3, that is, they provide structure at all polar angles about grid members 20-3 and are fixedly coupled thereto.

FIG. 14B also illustrates an optional tie off structure 275 that may allow luminaire 100-6 to be supported from above by a wire 277. Tie off structure 275 can enable implementation of luminaires 100-6 that might otherwise be judged to be too heavy for a grid ceiling system to support, especially when deployed in large numbers. Tie off structure 275 and wire 277 can bear, in certain embodiments, not only part or all of the weight of luminaire 100-6, but also part or all of a weight of a grid ceiling system in which it is deployed. The integration of tie off structure 275 with upper portion 120-6 of luminaire 100-6 is exemplary only; other embodiments can optionally integrate a tie off structure 275 with a lower portion 110 of a luminaire, or with multiple portions of a luminaire. One of ordinary skill in the art would recognize many variations, modifications, and alternatives.

Figure 15:
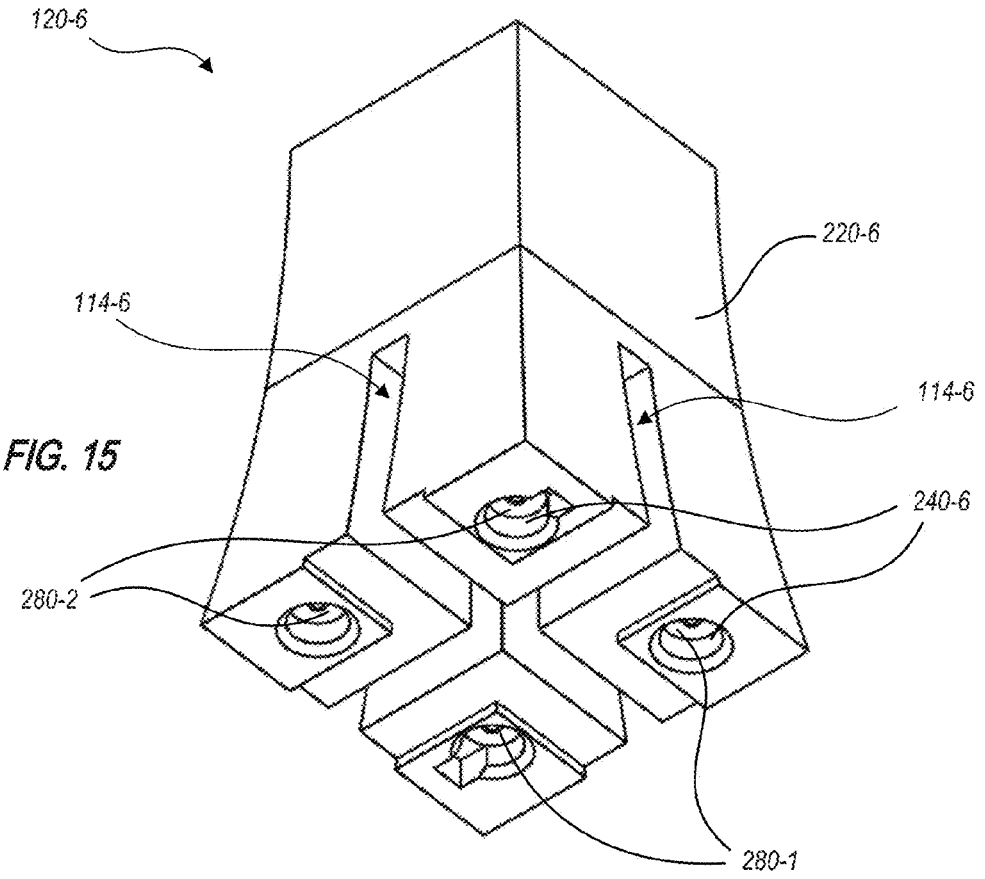
FIG. 15 illustrates the upper portion of the multipart luminaire of FIGS. 14A and 14B in greater detail.
Figure 16:
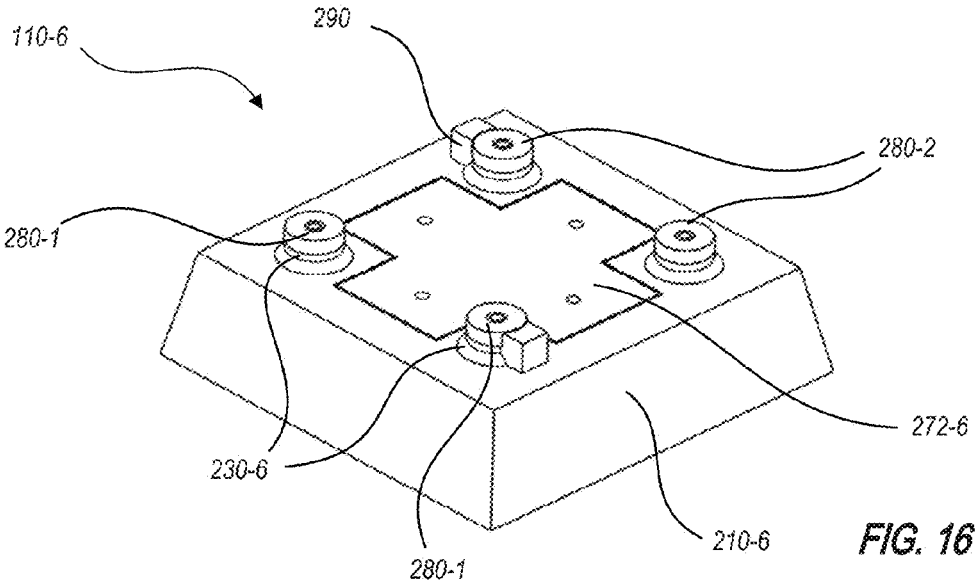
FIG. 16 illustrates the lower portion of the multipart luminaire of FIGS. 14A and 14B in greater detail.

FIG. 15 illustrates upper portion 120-6 of luminaire 100-6 in greater detail. In upper portion 120-6, mating elements 240-6 are shown as recesses within which are magnets 280, which may be for example high strength, rare earth magnets (e.g., neodymium magnets, commonly made of NdFeB). Magnets 280 are shown as having hollow, cylindrical "donut" configurations, which are useful as described below, but other configurations are possible. FIG. 16 illustrates lower portion 110-6 in greater detail. In lower portion 110-6, mating elements 230-6 are shown as magnets 280 (again, for example high strength, rare earth magnets) protruding from an upper surface of housing 210-6. Thus, when coupled, magnets 280 are shown as having a donut configuration. Although both mating elements 240-6 and 230-6 are illustrated as including magnets, in other embodiments only one of the mating elements includes a magnet, while the other mating element includes a ferromagnetic material that will be attracted to the magnet. Also, although donut configurations are shown, other configurations may be implemented. In embodiments, shapes of magnets and/or ferromagnetic materials used in mating elements 230, 240 are complementary such that the mating elements attract one another and urge portions 110-6, 120-6 into contact with one another when placed in proximity to one another. For example, mating elements 230-6 could be magnets, as shown in FIG. 16, but flat ferroelectric plates could be used as mating elements 240-6 in upper portion 120-6. Also, polarity of magnets 280 can be used as a keying feature, and/or may be used in combination with mechanical keying features, to ensure that luminaire 100-6 is assembled with a unique orientation of lower portion 110-6 to upper portion 120-6. For example, magnets 280-1 may be mounted in mating elements 240-6 with their south poles facing away from housing 220-6, while magnets 280-2 are mounted with their north poles facing away. A complementary arrangement is formed by magnets 280-1 and 280-2 in mating elements 230-6. This arrangement, along with mechanical keying features 290, allows luminaire 100-6 to be assembled in only one orientation of lower portion 110-6 to upper portion 120-6. An upper surface of an optional thermal spreader 272-6 is also shown in FIG. 16.

Figure 17:
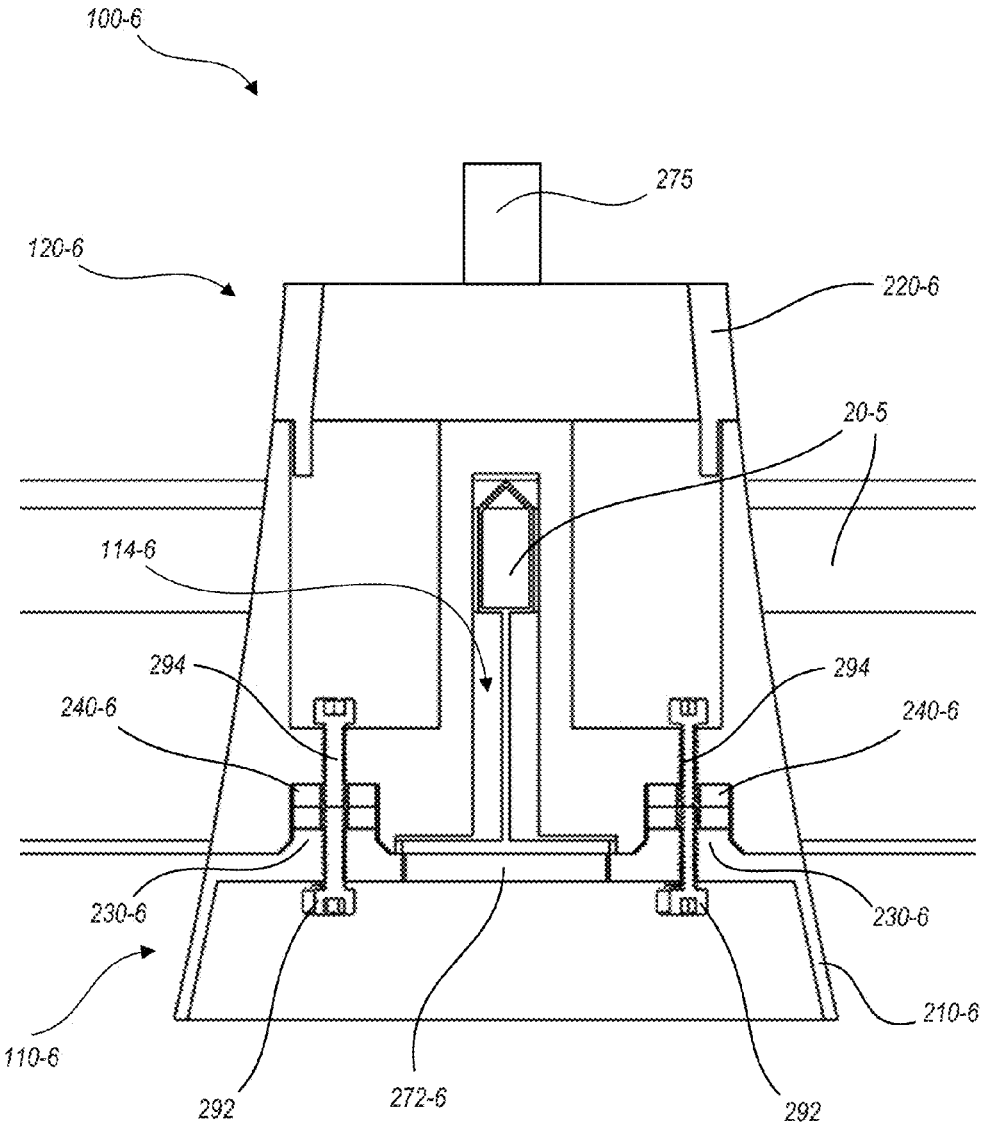
FIG. 17 is a schematic cross-sectional illustration of the multipart luminaire of FIGS. 14A and 14B with the upper portion and the lower portion assembled.

FIG. 17 is a schematic cross-sectional illustration of luminaire 100-6 with upper portion 120-6 and lower portion 110-6 assembled. The cross-sectional plane of FIG. 17 is taken through two sets of mating elements 230-6, 240-6 so as to show connecting pins 292, 294 connecting therethrough. Connecting pins 292, 294 can be disposed within mating elements 230-6, 240-6, as shown, to make electrical connections for a light engine of luminaire 100-6. Although FIG. 17 shows connecting pins 292, 294 as passing through center apertures of donut-shaped magnets of mating elements 230-6, 240-6, and making a butting contact at the same plane as the magnets, it is understood that many other configurations are possible. For example, connecting pins 292, 294 may be disposed adjacent to mating elements 230, 240 instead of passing through them, or may be disposed at other locations in housings 210, 220. Connecting pins 292, 294 may also make contact to complete circuits with each other in a variety of ways, for example through butting contacts, prong and socket type connectors, or pin and spring type connectors (e.g., such as connectors 260-4, 270-4, FIGS. 11, 12). One of ordinary skill in the art would recognize many variations, modifications, and alternatives. Tie off structure 275 is also shown.

Figure 18:
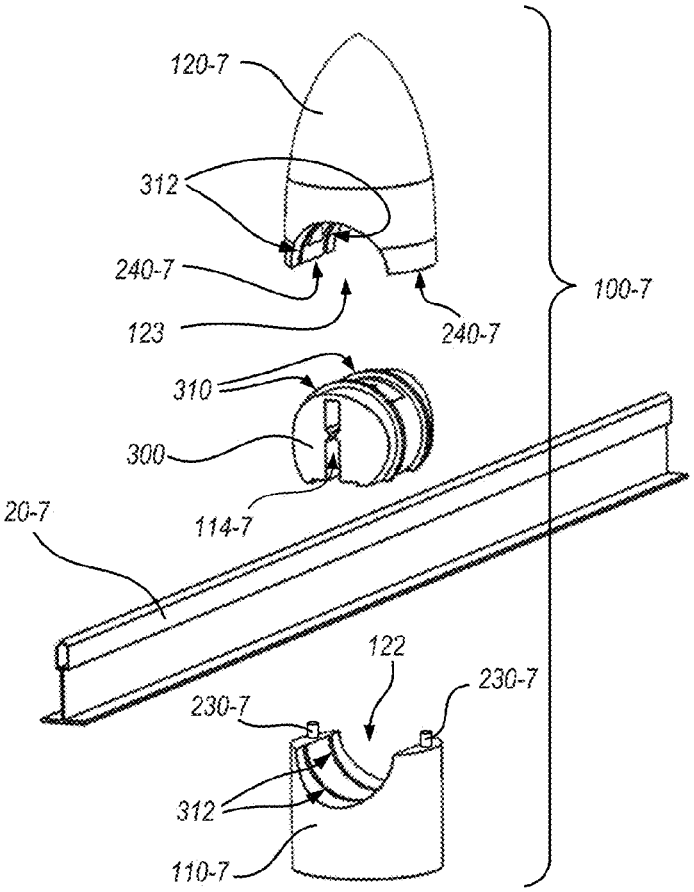
FIG. 18 is an exploded schematic illustration of a multipart luminaire that features upper and lower portions that are assembled about a pivot saddle, in accord with an embodiment.
Figure 19:
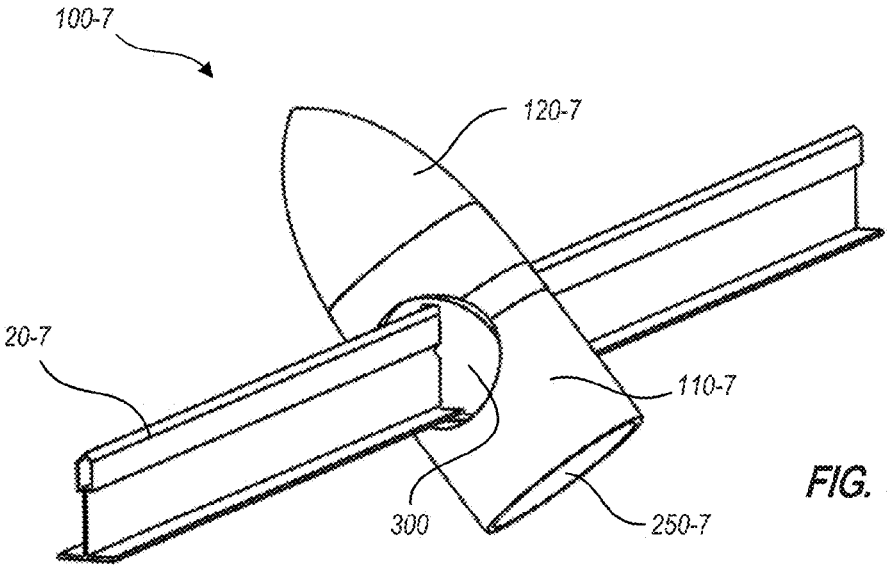
FIG. 19 illustrates the multipart luminaire of FIG. 18 after assembly, encompassing a grid member and showing upper and lower portions of the multipart luminaire tilted at an angle with respect to the grid member.

FIG. 18 is an exploded schematic illustration of a multipart luminaire 100-7 that features upper and lower portions 120-7, 110-7 that are assembled about a pivot saddle 300. FIG. 19 illustrates multipart luminaire 100-7 after assembly, encompassing a grid member 20-7 and showing upper and lower portions 120-7, 110-7 tilted at an angle with respect to grid member 20-7. Pivot saddle 300 fastens to grid member 20-7 by at least passing grid member 20-7 into a slot 114-7 therethrough, and forms at least a truncated portion of a cylinder. Upper and lower portions 120-7, 110-7 include respective semicylindrical recesses 122, 123. Upper and lower portions 120-7, 110-7 fasten around pivot saddle 300 with recesses 122, 123 facing pivot saddle 300, using mating elements 230-7, 240-7 (locations of mating elements 240-7 are indicated, but the mating elements themselves are hidden, in the view of FIG. 18). Thus, in the configuration shown in FIG. 18, pivot saddle 300 transfers a weight of luminaire 100-7 to grid member 20-7. In other embodiments, a multipart luminaire that includes a pivot saddle could also include an attachment point for a tie off such that part or all of the weight of the luminaire, and/or a portion of weight of the grid members, could be supported by the tie off. Lower portion 110-7 includes a light engine 250-7 that illuminates a space underneath grid member 20-7, similar to other embodiments herein.

Pivot saddle 300 may be formed of an elastically deformable material such as soft plastic or rubber to facilitate a snap fit around grid member 20-7. Such material may also help produce an appropriate resistance to rotation of upper and lower portions 120-7, 110-7 relative to grid member 20-7, after being assembled about pivot saddle 300. For example, pivot saddle 300 may include optional ribs 310 around an outer periphery thereof, and one or both of upper and lower portions 120-7, 110-7 may form grooves 312 sized and located so that ribs 310 seat within grooves 312 when assembled. The sizes of semicylindrical recesses 122, 123 and mating elements 230-7, 240-7 may be such that upper and lower portions 120-7, 110-7 form a friction or compression fit about pivot saddle 300. This fit can be made loose enough that upper and lower portions 120-7, 110-7 may be turned by hand about pivot saddle 300 to aim a light therefrom, but tight enough that upper and lower portions 120-7, 110-7 hold their position relative to grid member 20-7 when released. In other embodiments, adjustable mechanisms such as set screws or the like may be used to fix a rotational position of upper and lower portions 120-7, 110-7 relative to grid member 20-7. Light engine 250-7 may distribute light according to a native distribution and direction of a light source therein (e.g., a Lambertian distribution) or may include optics to direct light in different directions, diffuse, and/or concentrate the light in different ways.

The foregoing is provided for purposes of illustrating, explaining, and describing various embodiments. Having described these embodiments, it will be recognized by those of skill in the art that various modifications, alternative constructions, and equivalents may be used without departing from the spirit of what is disclosed. Different arrangements of the components depicted in the drawings or described above, as well as additional components and steps not shown or described, are possible. Certain features and subcombinations of features disclosed herein are useful and may be employed without reference to other features and subcombinations. Additionally, a number of well-known processes and elements have not been described in order to avoid unnecessarily obscuring the embodiments. Embodiments have been described for illustrative and not restrictive purposes, and alternative embodiments will become apparent to readers of this patent. Accordingly, embodiments are not limited to those described above or depicted in the drawings, and various modifications can be made without departing from the scope of the claims below. Embodiments covered by this patent are defined by the claims below, and not by the brief summary and the detailed description.

What is claimed is:

1. A luminaire configured for mounting to a grid ceiling system, wherein the grid ceiling system includes at least two grid members that form an intersection that divides an adjacent space into segments, the luminaire comprising:

a first portion that includes:

a first housing, a plurality of first mating elements coupled with the first housing, wherein the first housing is configured to dispose each of the first mating elements within one of the segments, and a light engine coupled with the first housing that generates light from electrical power, and is oriented to emit the light away from the first housing; and a second portion that includes:

a second housing, and a plurality of second mating elements, coupled with the second housing and disposed in correspondence with respective ones of the first mating elements, the plurality of second mating elements being adapted to couple with the plurality of first mating elements;

wherein:

at least one of the first portion and the second portion includes an electrical receptacle for receiving the electrical power from an external source for the light engine; and when the plurality of first mating elements couple with the plurality of second mating elements, the first housing and the second housing together define a cavity for the at least two grid members of the grid ceiling system, such that the luminaire encompasses the intersection.

2. The luminaire of claim 1, wherein at least a first one of the first and second mating elements comprises a magnet, and at least a second one of the first and second mating elements comprises one of a ferromagnetic material or a magnet.

3. A luminaire configured for mounting to a grid ceiling system, the luminaire comprising:

a first portion that includes:

a first housing, one or more first mating elements coupled with the first housing, and a light engine coupled with the first housing that generates light from electrical power, and is oriented to emit the light away from the first housing; and a second portion that includes:

a second housing, and one or more second mating elements coupled with the second housing, the one or more second mating elements being adapted to couple with the one or more first mating elements;

wherein:

at least one of the first portion and the second portion includes an electrical receptacle for receiving the electrical power from an external source for the light engine;

when the one or more first mating elements couple with the one or more second mating elements, the first housing and the second housing together define a cavity for one or more members of the grid ceiling system;

at least a first one of the first and second mating elements comprises:

a magnet that forms a hollow first shape with an aperture extending therethrough, and a first electrical connector that extends within the aperture; and at least a second one of the first and second mating elements comprises:

one of a magnet or a ferromagnetic material that forms a second shape that is complementary to the first shape, and a second electrical connector that is configured to couple with the first electrical connector to pass the electrical power between the first and second portions when the first one of the first and second mating elements couples with the second one of the first and second mating elements.

4. A luminaire configured for mounting to a grid ceiling system, the luminaire comprising:

a first portion that includes:

a first housing, a plurality of first mating elements coupled with the first housing, and a light engine coupled with the first housing that generates light from electrical power, and is oriented to emit the light away from the first housing; and a second portion that includes:

a second housing, and a plurality of second mating elements coupled with the second housing, the plurality of second mating elements being adapted to couple with the plurality of first mating elements;

wherein:

at least one of the first portion and the second portion includes an electrical receptacle for receiving the electrical power from an external source for the light engine;

when the plurality of first mating elements couple with the plurality of second mating elements, the first housing and the second housing together define a cavity for one or more members of the grid ceiling system;

the first portion includes a first plurality of magnets as the first mating elements;

the second portion includes a second plurality of magnets as the second mating elements, the second plurality being equal in number to the first plurality; and the first plurality of magnets and the second plurality of magnets couple with the respective first and second housings, in an arrangement wherein respective north and south poles of the first and second pluralities of magnets attract one another, and couple the first and second mating elements, only when the first portion and the second portion are in a unique orientation relative to one another.

5. The luminaire of claim 1, wherein:

the first portion and the second portion include respective first and second mechanical features that are shaped and disposed to fit with one another such that the first and second mating elements can couple only when the first portion and the second portion are in a unique orientation relative to one another.

6. The luminaire of claim 1, wherein:

at least one of the first mating elements comprises a first electrical connector; and at least one of the second mating elements comprises a second electrical connector; wherein the first electrical connector and the second electrical connector are configured to couple when the at least one of the first mating elements couples with the at least one second mating elements, so that the electrical connectors pass the electrical power between the first and second portions.

7. The luminaire of claim 1, wherein the light engine emits at least a portion of the light away from the first housing through the second portion before the light exits the luminaire.

8. The luminaire of claim 1, wherein the first housing includes a thermal spreader that is in thermal communication with the light engine, and is arranged such that the thermal spreader is in thermal communication with the at least two grid members of the grid ceiling system when the plurality of first mating elements couple with the plurality of second mating elements.

9. The luminaire of claim 1, wherein:

the at least two grid members of the grid ceiling system include at least one upwardly facing surface; and the second housing is adapted to obtain mechanical support from the at least one upwardly facing surface;

such that when the plurality of first mating elements couple with the plurality of second mating elements, the first and second mating elements transfer a weight of the first portion to the second housing and thus to the at least one upwardly facing surface of the at least two grid members of the grid ceiling system.

10. The luminaire of claim 1, wherein:

the first and second housings are sized and shaped so that when the plurality of first mating elements couple with the plurality of second mating elements, a photometric distribution of the light is centered about nadir.

11. The luminaire of claim 1, wherein:

the first and second housings are sized and shaped so that when the plurality of first mating elements couple with the plurality of second mating elements, a photometric distribution of the light is centered about a direction other than nadir.

12. The luminaire of claim 1, wherein the first and second housings are integrally formed with a living hinge connecting the first and second housings.

13. The luminaire of claim 3, wherein:

the first portion and the second portion include respective first and second mechanical features that are shaped and disposed to fit with one another such that the first and second mating elements can couple only when the first portion and the second portion are in a unique orientation relative to one another.

14. The luminaire of claim 3, wherein the light engine emits at least a portion of the light away from the first housing through the second portion before the light exits the luminaire.

15. The luminaire of claim 3, wherein the first housing includes a thermal spreader that is in thermal communication with the light engine, and is arranged such that the thermal spreader is in thermal communication with the one or more members of the grid ceiling system when the one or more first mating elements couple with the one or more second mating elements.

16. The luminaire of claim 3, wherein:

the one or more members of the grid ceiling system include at least one upwardly facing surface; and the second housing is adapted to obtain mechanical support from the at least one upwardly facing surface;

such that when the one or more first mating elements couple with the one or more second mating elements, the first and second mating elements transfer a weight of the first portion to the second housing and thus to the at least one upwardly facing surface of the one or more members of the grid ceiling system.

17. The luminaire of claim 4, wherein:

the first portion and the second portion include respective first and second mechanical features that are shaped and disposed to fit with one another such that the first and second mating elements can couple only when the first portion and the second portion are in a unique orientation relative to one another.

18. The luminaire of claim 4, wherein:

at least one of the first mating elements comprises a first electrical connector; and at least one of the second mating elements comprises a second electrical connector; wherein the first electrical connector and the second electrical connector are configured to couple when the at least one of the first mating elements couples with the at least one of the second mating elements, so that the electrical connectors pass the electrical power between the first and second portions.

19. The luminaire of claim 4, wherein:

the first and second housings are sized and shaped so that when the plurality of first mating elements couple with the plurality of second mating elements, a photometric distribution of the light is centered about nadir.

20. The luminaire of claim 4, wherein:

the first and second housings are sized and shaped so that when the plurality of first mating elements couple with the plurality of second mating elements, a photometric distribution of the light is centered about a direction other than nadir.

* * * * *